US007992872B2

(12) United States Patent
Simon

(10) Patent No.: US 7,992,872 B2
(45) Date of Patent: Aug. 9, 2011

(54) FOOSBALL TABLE

(76) Inventor: Steven Mark Simon, Austin, TX (US)

( * ) Notice: Subject to any disclaimer, the term of this patent is extended or adjusted under 35 U.S.C. 154(b) by 0 days.

(21) Appl. No.: 12/798,481

(22) Filed: Apr. 5, 2010

(65) Prior Publication Data

US 2010/0194038 A1 Aug. 5, 2010

Related U.S. Application Data

(62) Division of application No. 11/004,329, filed on Dec. 3, 2004, now Pat. No. 7,690,653.

(51) Int. Cl.
*A63F 9/24* (2006.01)
*A63F 7/06* (2006.01)

(52) U.S. Cl. ..... 273/108.52; 273/108.1

(58) Field of Classification Search ..... 273/118 A, 273/118 R, 126 A, 126 R, 122 R, 122 A, 273/125 R, 127 C, 108.1–108.57; 463/3, 463/4

See application file for complete search history.

(56) References Cited

U.S. PATENT DOCUMENTS

| | | | | |
|---|---|---|---|---|
| 4,065,128 | A * | 12/1977 | Gomori | 273/108.52 |
| 4,480,833 | A * | 11/1984 | Barcelow et al. | 273/108.56 |
| 4,691,920 | A * | 9/1987 | Murphy et al. | 463/3 |
| 5,967,518 | A * | 10/1999 | Rowe | 273/317.5 |
| 6,176,780 | B1 * | 1/2001 | Miyamoto et al. | 463/4 |
| 6,279,905 | B1 * | 8/2001 | Malavazos et al. | 273/126 A |
| 6,409,169 | B1 * | 6/2002 | Sutter | 273/108.1 |
| 6,773,010 | B2 * | 8/2004 | Zucchi et al. | 273/108.1 |
| 7,690,653 | B2 * | 4/2010 | Simon | 273/108.52 |
| 2007/0182093 | A1 * | 8/2007 | Giegerich et al. | 273/108 |

* cited by examiner

*Primary Examiner* — Nini Legesse
(74) *Attorney, Agent, or Firm* — Jeffrey M Hersh

(57) ABSTRACT

The present invention generally relates to a game device. In one aspect, a foosball game apparatus is provided. The foosball game apparatus includes a game body having a playing field, an endwall adjacent each end of the playing field, and a sidewall adjacent each side of the playing field. The foosball apparatus further includes an electronic digital display formed in each end wall for indicating a time period and a score. In another aspect, a method of playing a timed foosball game is provided.

12 Claims, 5 Drawing Sheets

FOOSBALL TABLE

CROSS-RELATED APPLICATION

This application is a Divisional Application of Ser. No. 11/004,329, filed on Dec. 3, 2004, which is expected to issue as U.S. Pat. No. 7,690,653, on Apr. 6, 2010.

BACKGROUND OF THE INVENTION

1. Field of the Invention

Embodiments of the present invention generally relate to a game device. More particularly, embodiments of the present invention pertain to a foosball game apparatus having a timing device.

2. Description of the Related Art

There are many types of game devices that are used as miniaturized versions of various athletic games. For instance, U.S. Pat. No. 3,881,726 issued on May 6, 1975, to G. Serafini discloses a miniature game of table soccer. The table top has a miniature soccer playing field thereon on which a plurality of figurine soccer players are moved into playing positions in respective zones. The figurines are mounted on end portions of respective metal tapes that can be individually advanced longitudinally and retracted and are individually transported transversely of the playing field. Manually actuated actuators advance and retract the tapes and move them transversely of the playing field zones for transporting the figurine soccer players individually into respective playing positions for kicking or throwing a playing ball. Goals and goalkeeper soccer players are actuated individually likewise by respective tapes.

U.S. Pat. No. 3,920,243, issued on Nov. 18, 1975 to A. Santos, Sr., teaches a soccer game which employs a substantially planer playing surface within which are formed a plurality of spaced apart recesses. A goal section is located at each longitudinal end of the playing surface and each goal section is protected by a playing member which is moveable there across. A spherical playing object is adapted to be locatable upon the playing surface. Each recess is constructed so that the playing object is caused to be positioned at the lowest part of each recess. The lowest part of each recess is located just forward of a playing member which is locatable within each said recess. The playing member is movable between a retracted position and an extended position to cause propelling of the playing object. The playing members are selectively actuatable by means of an actuating means connected at each end of the playing surface. Other soccer related examples are disclosed in U.S. Pat. Nos. 4,046,378, 4,025,073, 4,382,598, 5,058,892, 5,071,137, 5,072,880, 5,333,864, 5,419,555, 5,496,031, and 5,641,163.

Even though table soccer game apparatuses discussed above are similar to a miniaturized version of an actual athletic game, they lack a vital component of an actual athletic game that relates to time and set time periods. Therefore, there is a need for a table soccer game (foosball game) that is electronically capable of maintaining a time period and a score.

SUMMARY OF THE INVENTION

The present invention generally relates to a game device. In one aspect, a foosball game apparatus is provided. The foosball game apparatus includes a game body having a playing field, an endwall adjacent each end of the playing field, and a sidewall adjacent each side of the playing field. The foosball apparatus further includes an electronic digital display formed in each end wall for indicating a time period and a score.

In another aspect, a method of playing a timed foosball game is provided. The method includes dispensing a ball onto a playing field of a game body and starting a digital timer for measuring a predetermined amount of time. The method further includes generating an audio signal due to a triggering event.

In yet another aspect, a foosball apparatus is provided. The foosball apparatus includes a game body having a playing field, an endwall adjacent each end of the playing field, and a sidewall adjacent each side of the playing field, wherein the endwall is raised relative to the sidewall. The foosball apparatus further includes an electronic digital display electronically connected to a computer apparatus disposed in the game body, wherein the electronic digital display indicates a time period and a score.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
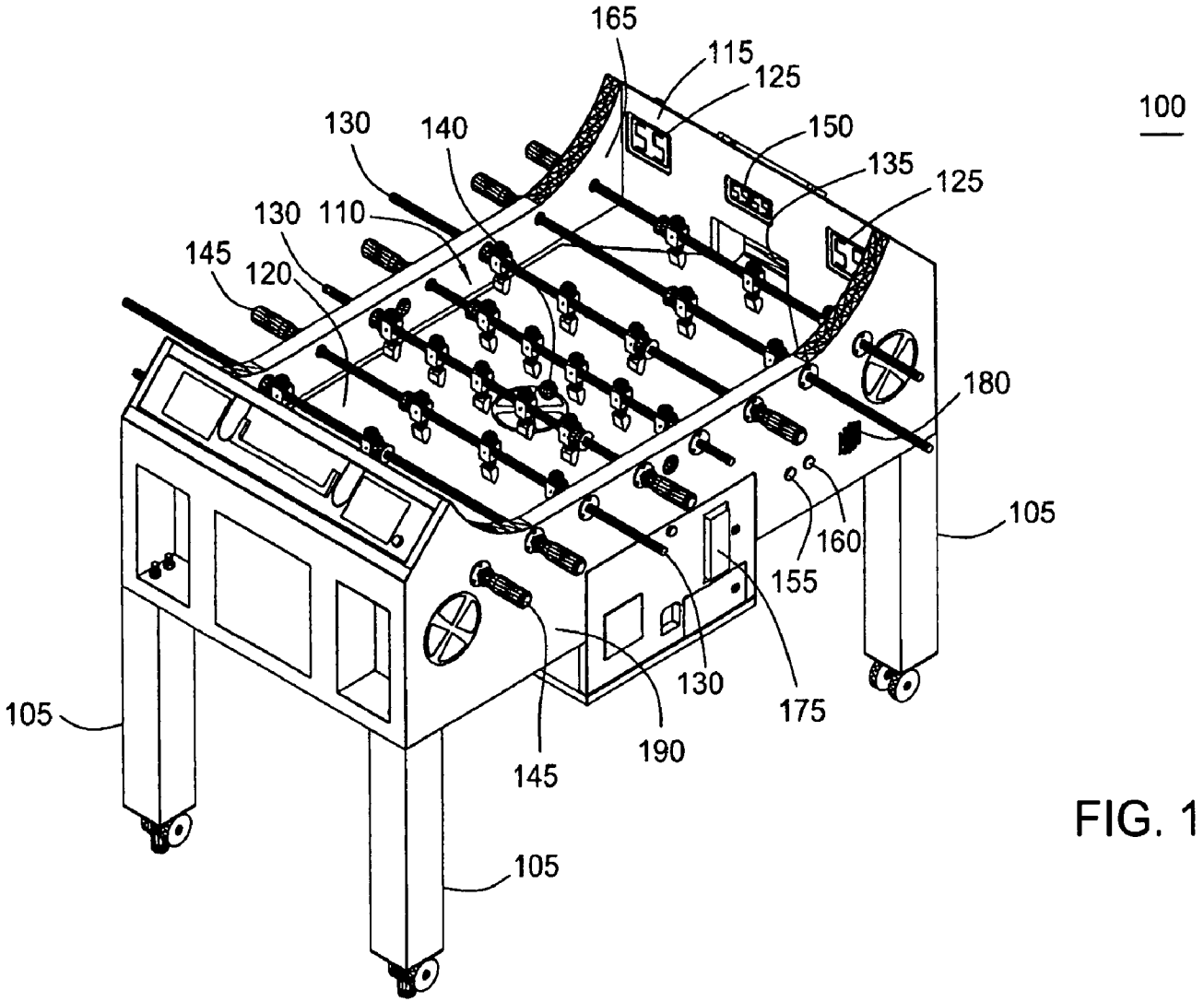
FIG. 1 is a perspective view of a game apparatus in accordance with the present invention.

The present invention is generally directed to a game apparatus having a timing device. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features described below. One of normal skill in the art of game devices will appreciate that the various embodiments of the invention can and may be used in all types of foosball (table soccer) games.

For ease of explanation, the invention will be described generally in relation to a foosball game. It is to be understood, however, that the invention may be employed in any number of table games without departing from principles of the present invention.

FIG. 1 is a perspective view of a game apparatus 100 in accordance with the present invention. As shown, the game apparatus 100 includes a game body 190 and a plurality of legs 105 for supporting the game body 190 on the floor. It should be understood, however, that the game body 190 may be supported by any means without departing from principles of the present invention.

The game body 190 includes a pair of sidewalls 110 and a pair of raised endwalls 115. The game body 190 further includes a playing field 120 operatively attached to each raised endwall 115 and each sidewall 110. Each raised endwall 115 is constructed and arranged to house an electronic digital display such as a score display 125 and a clock display 150. Further, each endwall 115 is raised to a predetermined height relative to the sidewall 110 to allow a ball 140 to remain "in play" during the game rather than being displaced from the game body 190. Additionally, at the interface between each sidewall 110 and each endwall 115, a raised sidewall portion 165 is formed. The raised sidewall portion 165 also helps to maintain the ball 140 "in play" during the game rather than being displaced from the game body 190.

The game body 190 also includes eight rods 130 that extend across game body 190 and through each sidewall 110. Each of the rods 130, include handles 145 that extend outwardly from the sidewalls 110. The rods 130 carry a plurality of paddles. Respective rods are mounted for a push-pull movement and also for rotatory movement in relation to the sidewall 110.

The game body 190 further includes a goal 135 formed in each raised endwall 115. The goal 135 contains an internal sensor (not shown) that is electronically connected to the electronic digital display such as the score display 125 and the clock display 150 through an internal computer apparatus 400, shown in FIG. 3. Generally, as the ball 140 is propelled down the playing field 120 into the goal 135, the computer apparatus records the point and re-displays the score on the score display 125 after the ball enters the goal 135. The interrelationship between the goal 135, the score display 125, and the clock 150 will be described in greater detail in subsequent paragraphs along with a timeout button 155 and a speaker 180.

As illustrated in FIG. 1, the running clock 150 is integral in each raised endwall 115. The location of the clock 150 in each raised endwall 115 permits each player to focus on the game at hand without having to appreciably raise his eyes or head. Thus, each player remains visibly aware of the time remaining on the clock 150. Typically, the clock 150 operates until reaching a preset amount of time. The clock 150 is initiated into running by the insertion of monies, coins, tokens, or other acceptable items into the coin mechanism 175. The time allotted "counts-down" from the preset amount of time allotted for the duration of the game. Each player has an option to stop the time countdown by pressing the timeout button 155.

In one embodiment, the clock 150 includes a time period indicator (not shown). The time period indicator is electronically connected with the counter in the computer apparatus 400. The time period indicator is used to visually indicate a game time period and thereby permit players a visual reminder of the period As shown in FIG. 1, the game body 190 also includes the score display 125 disposed in each raised endwall 115. The score display 125 is electronically connected to the goal 135 through the computer apparatus. As a player propels the ball 140 into the goal 135, the ball 140 activates a sensor and the computer apparatus 400 sends a signal to the appropriate score display 125 to indicate a point was scored. The location of the score display 125 like the clock 150 permits the player to focus on the game without having to raise his eyes or head.

The game body 190 further includes a sound memory assembly (not shown). The sound memory assembly typically comprises a sound memory, a sound generator, an amplifier, and the speaker 180. The sound generator is made of a type well known by those of ordinary skill in the art and functions by receiving digital signals from the computer apparatus 400 and then converting the signal into audio signals which are then amplified and sounded through the speaker 180. The game controller obtains digital signals representative of noises, sounds, or speech typically associated with a sporting event. For example, a sound or some other triggering event such as scoring or applause representative to the play of the game is broadcasted through the speaker 180.

Triggering events could include the scoring of the ball 140 into the goal 135, the completion of a period of a game, achievement of a particular goal in a given round, notice or announcement of a minimal time left to play the entire game, minimal time left for a timeout period after initiating the timeout button 155, or a sound after the coins/tokens are inserted for starting the game that alerts the players a game is about to start. The sound assembly could also be used if a player does something reflecting a favorable quality of activity associated with the game such as moving the ball 140 down the playing field 120 in an efficient manner. Typically, the computer apparatus 400 queries the sound or speech memory for a sound or speech indicative of a positive or a laudatory response for the player. The appropriate digital signal is received by the computer apparatus 400 from the sound memory and then sent to the sound generator where the digital signals are converted into corresponding audio signals and then amplified and sounded by the speaker 180 for the player to hear.

As shown in FIG. 1, the game body 190 includes the timeout button 155 in each sidewall on the outside face. The timeout button 155 is associated with a time clock 150. During that time period in progress, a player may push the timeout button 155 to obtain a predetermined timeout period. The timeout period automatically stops the clock 150.

The game body 190 further includes a management button 160 disposed in the sidewall 110. The management button 160 allows a game official to change a time period allotted to the game or reset the time clock 150 at an appropriate time. Further, the management button 160 may include a means which enables the time period to be selected from a 1 minute game period to a 99 minute game period.

Figure 2:
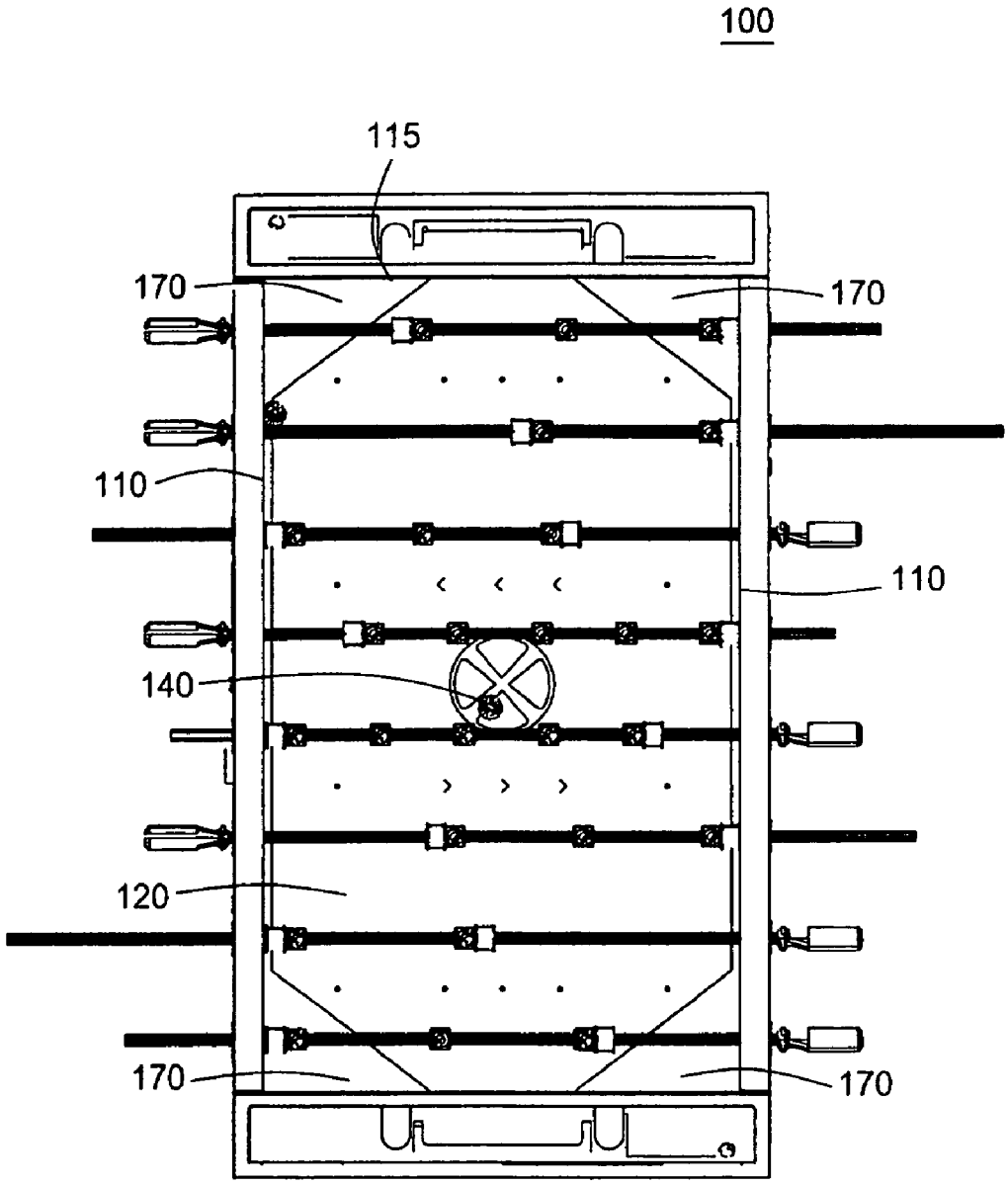
FIG. 2 is a top view of the game apparatus in FIG. 1.

FIG. 2 is a top view of the game apparatus 100. As shown, the playing field 120 includes a plurality of corner displays 170 at the interface between each sidewall 110 and endwall 115.

Figure 3:
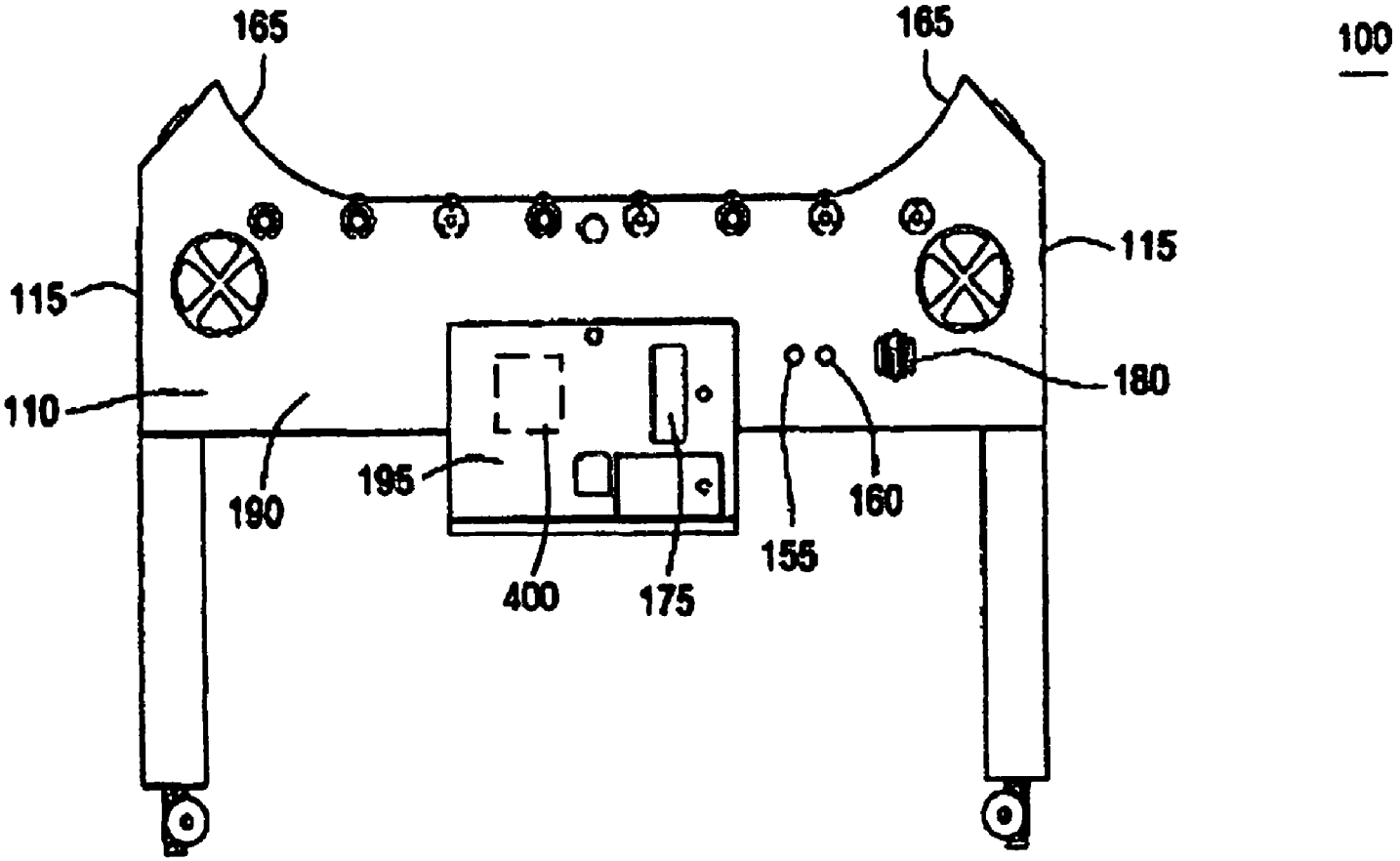
FIG. 3 is a side view of the game apparatus in FIG. 1.

FIG. 3 is a side view of the game apparatus 100. The game apparatus 100 includes a coin mechanism assembly 175 mounted into the drawer assembly 195. The coin mechanism assembly 175 includes circuitry and mechanical components to receive coins/tokens to start the game apparatus 100. Also clearly shown in FIG. 3 is the location of the timeout button 155, the management button 160 and the speaker 180. Additionally, the curvature of the raised sidewall 165, used to keep the ball 140 in constant play without leaving the play field 120 is clearly shown.

Figure 4:
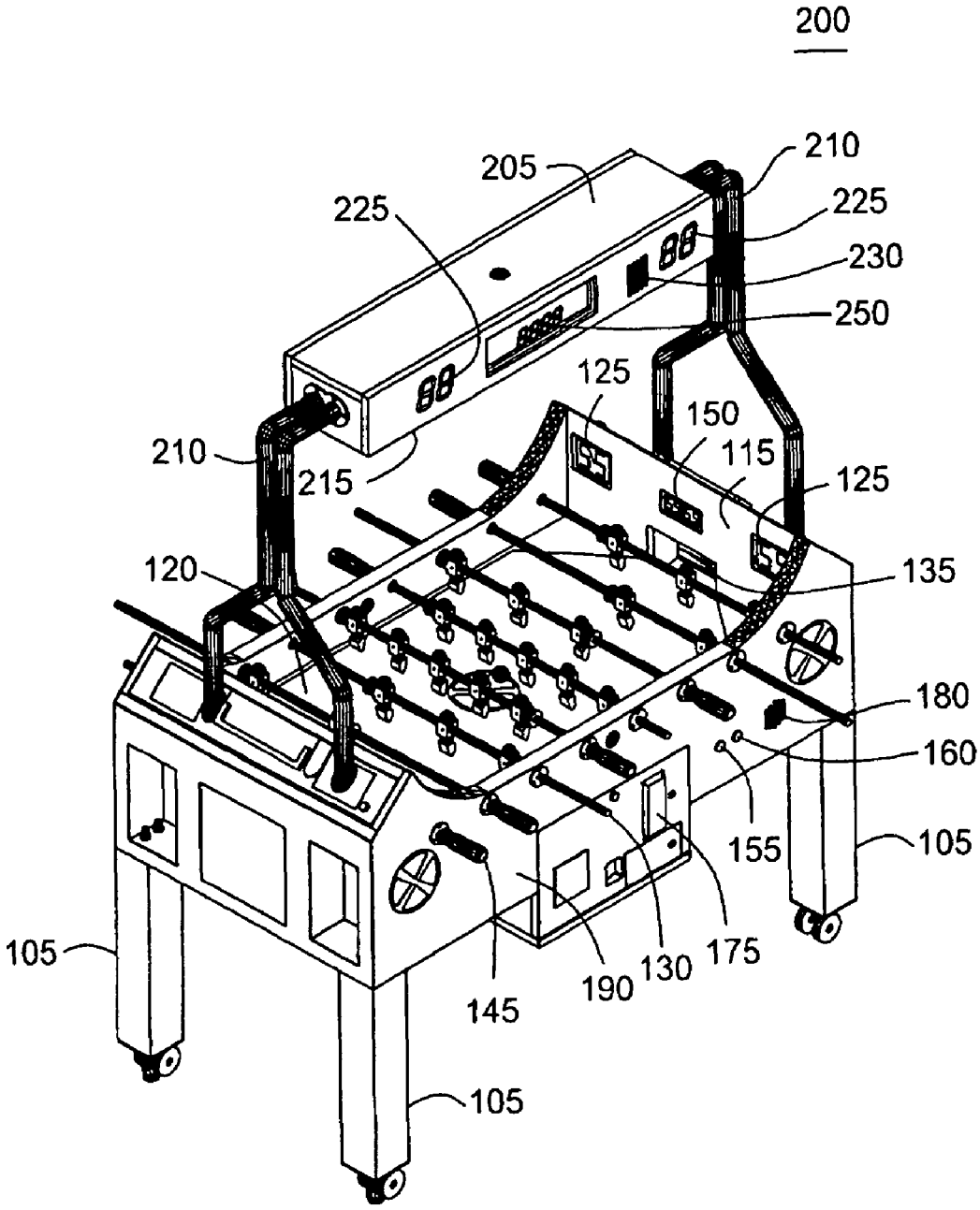
FIG. 4 is an alternative embodiment of a game apparatus.

FIG. 4 is an alternative embodiment of a game apparatus 200. For convenience, the components in the game apparatus 200 that are similar to the components in the game apparatus 100 will be labeled with the same number indicator.

As shown in FIG. 4, the game apparatus 200 includes a light fixture 205 operatively attached to the game body 190 by a plurality of supports 210. The light fixture 205 includes a light source 215 for providing light. The light fixture 205 further includes an electronic digital display such as a score display 225 and clock display 250. In a similar manner as discussed above, the goal 135 contains an internal sensor (not shown) that is electronically connected to the score display 225 and the clock display 250 through an internal computer apparatus 400 (not shown in FIG. 4). The apparatus 200 may also include a score display 125 and time display 150 formed in the raised endwall 115 as discussed above. It should be understood, however, that the score display and the time display may be located in both the light fixture 205 and the raised endwall 115 or in either the light fixture 205 or the raised endwall 115, without departing from principles of the present invention. Additionally, the light fixture 205 may include a speaker 230 for broadcasting a sound due to a triggering event such as scoring or applause representative to the play of the game as discussed above.

Figure 5:
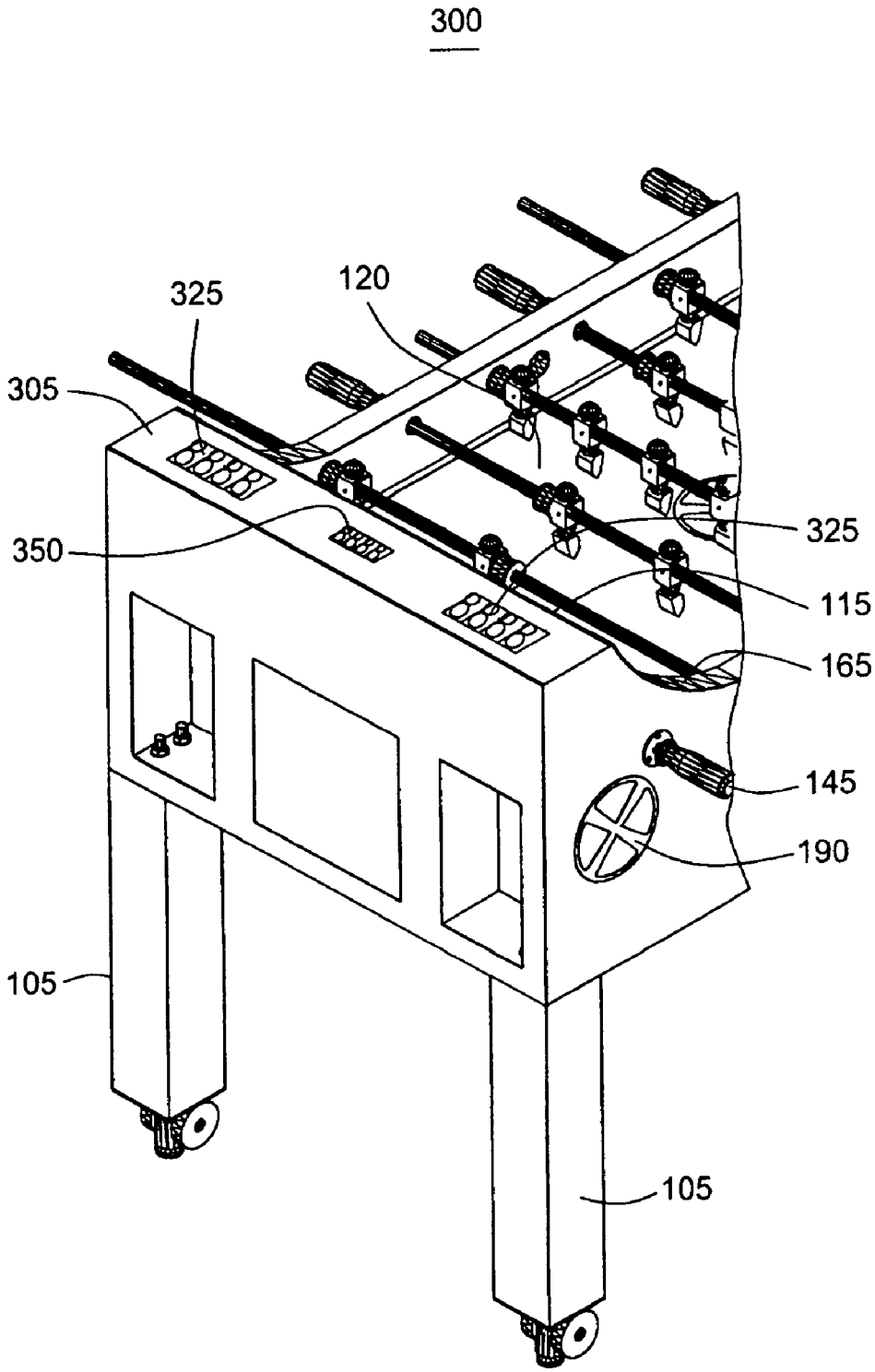
FIG. 5 is an alternative embodiment of a game apparatus.

FIG. 5 is an alternative embodiment of a game apparatus 300. For convenience, the components in the game apparatus 300 that are similar to the components in the game apparatus 100 will be labeled with the same number indicator.

As shown in FIG. 5, the game apparatus 300 includes an electronic digital display such as score display 325 and clock display 350 formed in a top wall 305 of the game body 190. In a similar manner as discussed above, the goal (not shown) contains an internal sensor (not shown) that is electronically connected to the score display 325 and the clock display 350 through an internal computer apparatus 400 (not shown in FIG. 5).

While the foregoing is directed to embodiments of the present invention, other and further embodiments of the invention may be devised without departing from the basic scope thereof, and the scope thereof is determined by the claims that follow.

The invention claimed is:

1. A method of playing a foosball game on a mechanical foosball table having a playfield, two goals opposite each other, a plurality of rods that extend completely across the playfield, a plurality of paddles attached to the rods, and a computer that activates and deactivates the mechanical foosball table, the method comprising the steps of:

activating the mechanical foosball table to initiate play for a first predetermined period of time;

playing foosball on the mechanical foosball table during the first predetermined period of time;

selectively initiating a plurality of timeouts, with each timeout temporarily deactivating the mechanical foosball table, thereby suspending play for a second predetermined period of time;

resuming play when the mechanical foosball table automatically reactivates when the second predetermined period of time expires; and terminating play when the mechanical foosball table automatically deactivates when the first predetermined period of time has expired;

wherein the duration of time from activating the mechanical foosball table until terminating play extends for the first predetermined period of time plus the product of the number of timeouts and the second predetermined period of time.

2. The method of playing foosball according to claim 1 wherein the first predetermined period of time is six (6) minutes.

3. The method of playing foosball according to claim 1 wherein the first predetermined period of time is eight (8) minutes.

4. The method of playing foosball according to claim 1 wherein the second predetermined period of time is thirty (30) seconds.

5. The method of playing foosball according to claim 1 wherein each player (or each team when it's a doubles match) may selectively initiate solely up to one timeout during play.

6. The method of playing foosball according to claim 5 wherein the first predetermined period of time is six (6) minutes.

7. The method of playing foosball according to claim 5 wherein the first predetermined period of time is eight (8) minutes.

8. The method of playing foosball according to claim 5 wherein the second predetermined period of time is thirty (30) seconds.

9. The method of playing foosball according to claim 8 wherein the first predetermined period of time is six (6) minutes.

10. A method of playing foosball comprising the steps of:

activating a foosball table to initiate play for a first predetermined period of time;

playing foosball on the foosball table during the first predetermined period of time;

selectively initiating a plurality of timeouts, with each timeout temporarily deactivating the foosball table, thereby suspending play for a second predetermined period of time;

resuming play when the foosball table automatically reactivates when the second predetermined period of time expires; and terminating play when the foosball table automatically deactivates when the first predetermined period of time has expired.

11. The method of playing foosball according to claim 10 wherein the duration of time from activating the foosball table until terminating play extends for the first predetermined period of time plus the product of the number of timeouts and the second predetermined period of time.

12. The method of playing foosball according to claim 10 wherein each player (or each team when it's a doubles match) may selectively initiate solely up to one timeout during play.

* * * * *